United States Patent [19]

Ketchel

[11] 3,940,196

[45] Feb. 24, 1976

[54] SAFETY CABINET FOR BATHTUB FAUCETS

[76] Inventor: Donald F. Ketchel, 7375 9th St., Apt. 224, Buena Park, Calif. 90620

[22] Filed: Nov. 14, 1974

[21] Appl. No.: 523,678

[52] U.S. Cl. ..... 312/237; 312/228

[51] Int. Cl.[2] ..... A47B 55/00

[58] Field of Search ..... 292/52, 53, 228; 4/191–193, 195; 220/246, 315, 316, 323, 352; 312/228, 229, 237

[56] References Cited

UNITED STATES PATENTS

| | | | |
|---|---|---|---|
| 3,071,425 | 1/1963 | West | 312/205 |
| 3,208,781 | 9/1965 | Appleberry | 292/228 |
| 3,532,373 | 10/1970 | Poe | 292/53 |
| 3,575,481 | 4/1971 | Phlieger, Jr. | 312/228 |
| 3,827,088 | 8/1974 | Arnold et al. | 4/192 |

*Primary Examiner*—Casmir A. Nunberg
*Attorney, Agent, or Firm*—Richard Esty Peterson

[57] ABSTRACT

A cabinet for enclosing the faucets of a bathtub having a spring loaded latch requiring an operating force of sufficient magnitude to prevent small children from operating the cabinet and operating the faucets.

7 Claims, 3 Drawing Figures

SAFETY CABINET FOR BATHTUB FAUCETS

BACKGROUND AND SUMMARY OF THE INVENTION

It is occasionally the case that a small child left alone even momentarily in a bathtub during bathing will operate the faucets with the imminent danger of scalding himself. In order to eliminate this hazard, I have invented a faucet cabinet which is adapted to enclose the faucets in a bathtub. The cabinet has a cover lid which can be opened to expose the faucets for use. The lid has a latch with a spring release for locking the lid when the cabinet is closed. The spring release requires an operating force of sufficient magnitude that a child will be unable to operate the release and open the lid. The cabinet is preferably fabricated from a molded plastic which is water resistant and easily cleaned. The cabinet also preferably includes a combination lid handle and wash cloth rack, and a side mounted soap dish.

While the cabinet is principally for the protection of children, it is also useful for others, particualrly elderly persons, to prevent accidental operation of the faucets while bathing. These and other features will become evident from the following detailed description of the preferred embodiment.

DETAILED DESCRIPTION OF THE PREFERRED EMBODIMENT

Figure 1:
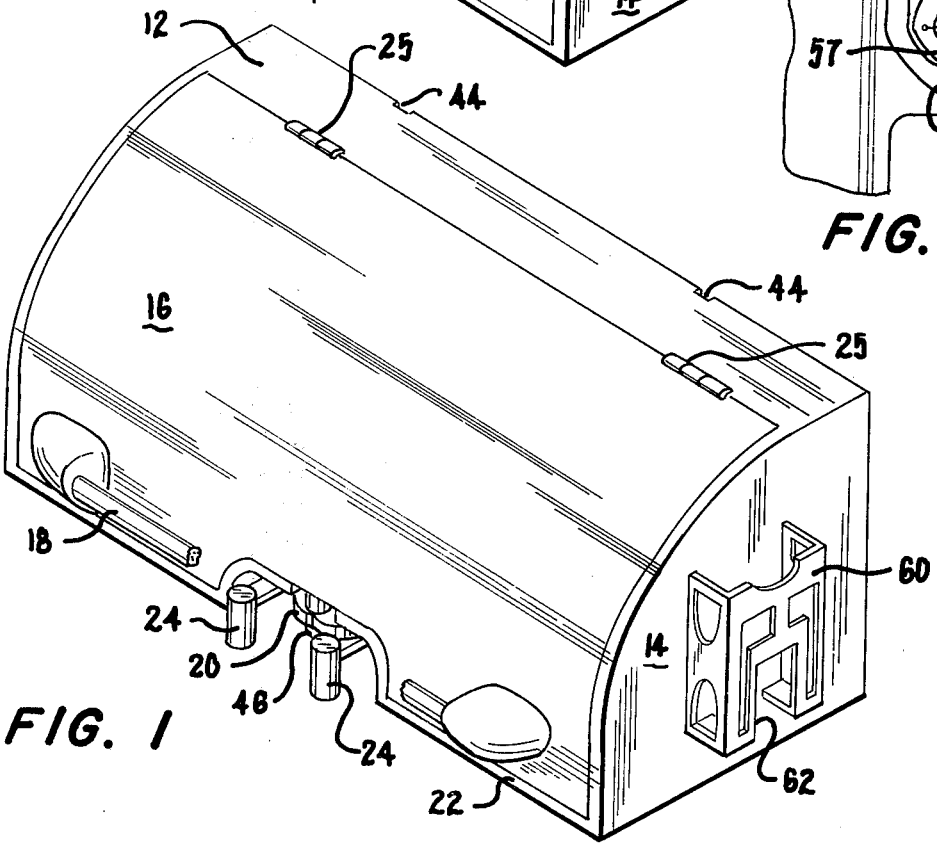
FIG. 1 is a perspective view of the faucet cabinet with cover closed.

Referring to FIG. 1 the faucet cabinet shown therein and designated generally by the reference numeral 10 provides an enclosure concealing the faucets of a bath tub. The cabinet 10 is formed with a top 12, contoured sidewalls 14 and a curved front cover 16. The front cover 16 has a handle 18 mounted to the bottom front edge of the cover, which handle is sufficiently elongated to serve also as a rack for wash cloth. The handle 18 in FIG. 1 is illustratively broken away to reveal a latching mechanism 20 for securing the cover 16 to a cabinet bottom 22.

Figure 2:
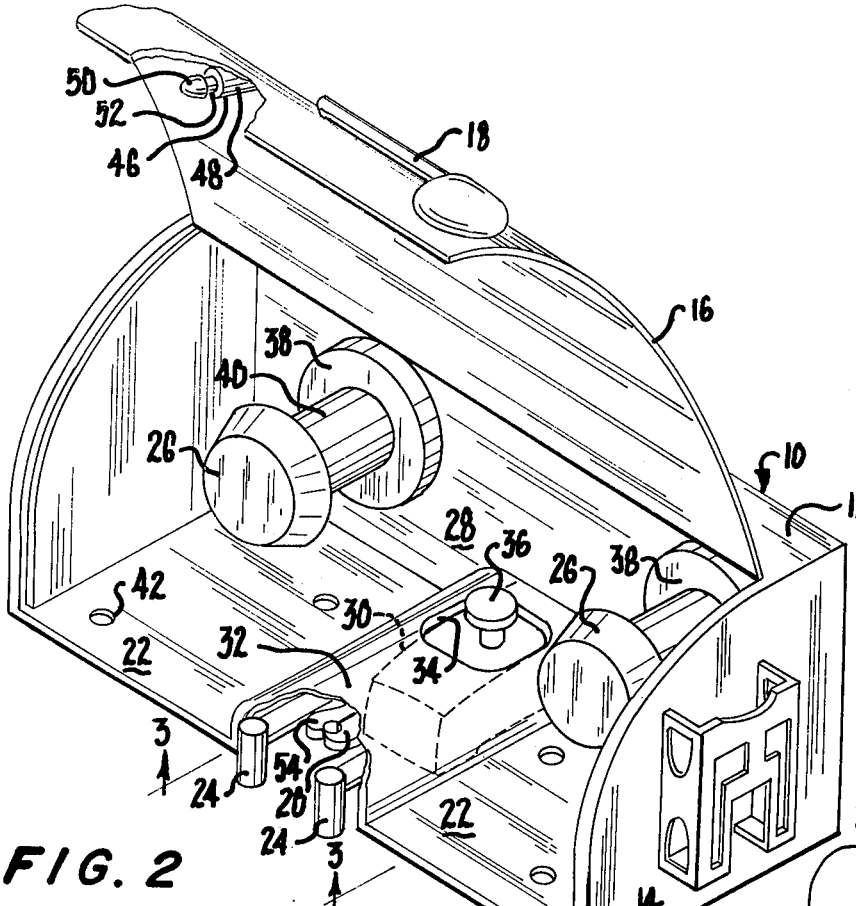
FIG. 2 is a perspective view of the faucet cabinet with cover opened.

The latching mechanism 20 includes two projecting finger levers 24 which when compressed together by a user will release the cover allowing it to be opened as shown in FIG. 2 on hinges 25.

Referring now to FIG. 2 the faucet cabinet is illustrated with cover 16 opened to show the arrangement of the cabinet over a conventional tub faucet having two knobs 26 projecting through holes (not shown) in a back panel 28 of the cabinet 10, and spigot 30 positioned under a raised central segment 32 in the cabinet bottom 22. The raised central segment 32 includes an aperture 34 through which a shower knob 36 projects when its cabinet is used with a faucet set of the type shown. Faucet flanges 38 are annularly arranged around the faucet knob stems 40 against the back panel 28 for appearance.

For purposes of drainage of splashed or dripped water, several holes 42 in the cabinet bottom 22 are provided to drain water in the cabinet, and grooves 44 are provided in the outside of the back panel 28 to allow water dripping from a wall to pass behind the cabinet when the cabinet is fastened to a bathroom wall by appropriate conventional fasteners.

The latching mechanism 20 includes a boss 46 which projects from a cover mount 48 as shown in FIG. 2 in the broken away segment of the cover. The boss 46 has a rounded end 50 and an annular neck groove 52. The boss is engageable with a pair of spring biased pincers 54 operable by the finger levers 24. On closing the cover the locking mechanism can either be engaged by forcing the boss 46 between the pincers 54, or, the pincers can be separated by manipulation of the finger levers 24 until the cover is closed allowing the pincers 54 to engage the neck groove 52 on release.

Figure 3:
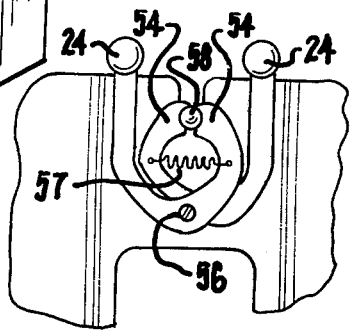
FIG. 3 is a fragmentary bottom view of the latch mechanism taken on the lines 3—3 in FIG. 2.

The latching mechanism is shown with greater clarity in the fragmentary view of the underside of the faucet cabinet shown in FIG. 3. The pincers 54 are integrally connected to the finger levers 24 and pivotally interconnected by pivot screw 56. Between the two pincers 54 is a tension spring 57. The arrangement is such that when the finger levers 24 are squeezed together the ends 58 of the pincers 54 separate. By proper selection of the spring the latching mechansim 20 can be operated by an adult or older child, but not an infant. For example, a spring causing a required compressure force of five pounds to be exerted at the finger levers 24 to release the cover is adequate to prevent infant operation.

The preferred embodiment includes a soap container 60 mounted to a side wall 14 of the cabinet. The container 60 is skeletal in form for adequate ventilation and drying of a soap bar (not shown) placed in the container 60 through the open top. An open side slot 62 on the lower portion of the container side enables a soap bar to be raised from below by a user's finger.

I claim:

1. A faucet cabinet adapted to enclose faucet knobs for the protection of young children comprising: an enclosure adapted to mount over and enclose at least one faucet knob, said enclosure having a cover operable between a closed position enclosing at least one faucet knob and an open position exposing enclosed faucet knobs, and, latching means for latching said cover in said enclosed position, said latching means having a release with a bias means for providing a predetermined magnitude of force in operating said release, said predetermined magnitude of force being such that said release is operable by an adult and is inoperable by a young child.

2. The Faucet cabinet of claim 1 wherein said cover includes an elongated handle adapted to support a wash rag.

3. The faucet cabinet of claim 1 wherein said enclosure is mountable over faucet knobs and above a spigot of a tub, said enclosure having an aperture through which a shower knob is projectable.

4. The faucet cabinet of claim 1 wherein said latching means comprises a boss projecting from a bottom edge of said cover, said boss having a narrow neck portion, and a pair of spring biased pincers mounted in said enclosure, said pincers having an end portion engageable with said boss and said narrow neck portion of said boss when said cover is closed.

5. The faucet cabinet of claim 4 wherein said enclosure has a bottom panel and said pincers are mounted on a pivot on said bottom panel, and wherein said pincers have an extension beyond said pivot opposite said boss engageable end portion, said extension of each pivot projecting from said enclosure and comprising a pair of finger levers for releasing said latching means.

6. The faucet cabinet of claim 5 wherein said bias means comprises a tension spring having ends connected to said pincers.

7. The faucet cabinet of claim 1 having a soap container connected to said enclosure, said soap container having an open top and a skeletal structure with a side having an open portion adapted for insertion of a finger to lift a bar of soap from the container.

* * * * *